US006394888B1

(12) United States Patent
Matsumoto et al.

(10) Patent No.: US 6,394,888 B1
(45) Date of Patent: May 28, 2002

(54) ABRASIVE TOOLS FOR GRINDING ELECTRONIC COMPONENTS

(75) Inventors: Dean Matsumoto, Worcester; William F. Waslaske, Rutland; Bethany L. Sale, Worcester, all of MA (US)

(73) Assignee: Saint-Gobain Abrasive Technology Company, Worcester, MA (US)

( * ) Notice: Subject to any disclaimer, the term of this patent is extended or adjusted under 35 U.S.C. 154(b) by 0 days.

(21) Appl. No.: 09/322,945

(22) Filed: May 28, 1999

(51) Int. Cl.[7] ..... B24B 33/00

(52) U.S. Cl. ..... 451/548; 451/541; 451/551; 51/309

(58) Field of Search ..... 451/548, 551; 51/293, 302, 309, 295; 57/298

(56) References Cited

U.S. PATENT DOCUMENTS

| | | | | | |
|---|---|---|---|---|---|
| 2,806,772 | A | | 9/1957 | Robie | |
| 2,986,455 | A | | 5/1961 | Sandmeyer | |
| 3,661,544 | A | | 5/1972 | Whitaker | |
| 3,916,574 | A | | 11/1975 | Prunier | |
| 4,317,314 | A | | 3/1982 | Carlström et al. | |
| 4,799,939 | A | | 1/1989 | Bloecher et al. | |
| 4,920,704 | A | * | 5/1990 | Caserta et al. | 51/302 |
| 5,035,087 | A | | 7/1991 | Nishiguchi et al. | |
| 5,037,452 | A | * | 8/1991 | Gary et al. | 51/293 |
| 5,203,886 | A | | 4/1993 | Sheldon et al. | |
| 5,607,489 | A | * | 3/1997 | Li | 51/309 |
| 5,658,194 | A | | 8/1997 | Micheletti | |
| 5,834,569 | A | | 11/1998 | Srinivasan et al. | |
| 5,961,674 | A | * | 10/1999 | Gagliardi et al. | 51/295 |
| 5,964,646 | A | | 10/1999 | Kassir et al. | |
| 5,989,114 | A | * | 11/1999 | Donohue et al. | 451/548 |
| 6,019,668 | A | * | 2/2000 | Ramanath | 451/41 |
| 6,039,775 | A | * | 3/2000 | Ho et al. | 51/295 |
| 6,093,092 | A | * | 7/2000 | Ramanath | 451/541 |
| 6,102,789 | A | * | 8/2000 | Ramanath | 451/541 |

FOREIGN PATENT DOCUMENTS

| | | |
|---|---|---|
| FR | 2704473 | 11/1994 |
| GB | 2102445 A | 2/1983 |
| WO | 98/03306 | 1/1998 |
| WO | 00/36637 | 6/2000 |

OTHER PUBLICATIONS

PCT International Search Report, Aug. 25, 2000, First Sheet, pp. 1/2, Annex, Rijswijk, Netherlands.
PCT Notification of Transmittal of the International Search Report or the Declaration, Aug. 25, 2000, 3 Pgs., Rijswijk, Netherlands.

* cited by examiner

*Primary Examiner*—George Nguyen
(74) *Attorney, Agent, or Firm*—Mary E. Porter

(57) ABSTRACT

Abrasive tools containing high concentrations of hollow filler materials in a resin bond are suitable for polishing and backgrinding of hard materials, such as ceramic wafers and components requiring a controlled amount of surface defects. These highly porous abrasive tools comprise fine grit abrasive grain, such as diamond abrasive, along with the hollow filler material and resin bond.

13 Claims, No Drawings

ABRASIVE TOOLS FOR GRINDING ELECTRONIC COMPONENTS

This invention relates to porous, resin bonded abrasive tools suitable for surface grinding and polishing of hard materials, such as ceramics, metals and composites comprising ceramics or metals. The abrasive tools are useful in backgrinding of silicon and alumina titanium carbide (AlTiC) wafers used in the manufacture of electronic components. These abrasive tools grind ceramics and semiconductors at commercially acceptable material removal rates and wheel wear rates with less workpiece damage than conventional superabrasive tools.

An abrasive tool designed to yield faster and cooler cutting action during grinding is disclosed in U.S. Pat. No. 2,806,772. The tool contains about 25 to 54 volume percent abrasive grain in about 15 to 45 volume percent resin bond. The tool also contains about 1–30 volume percent of pore support granules, such as vitrified clay thin walled hollow spheres (e.g., Kanamite balloons) or heat expanded (intumescent) perlite (volcanic silica glass) to separate the abrasive grain particles for better cutting and less loading of the grinding face with debris from the workpiece. The pore support granules are selected to be about 0.25 to 4 times the size of the abrasive grain.

An abrasive tool containing only fused alumina bubbles and no abrasive grain is disclosed in U.S. Pat. No. 2,986,455. The tool has an open, porous structure and free-cutting characteristics. Resin bonded wheels made according to the patent are used to grind rubber, paper fiber board and plastics.

Erodable agglomerates useful in making abrasive tools are disclosed in U.S. Pat. No. 4,799,939. These materials contain abrasive grain in resin bond materials and up to 8 weight percent hollow bubble material. The agglomerates are described as being particularly useful in coated abrasives.

An abrasive tool suitable for grinding surfaces of sapphire and other ceramic materials is disclosed in U.S. Pat. No. 5,607,489 to Li. The tool is contains metal clad diamond bonded in a vitrified matrix comprising 2 to 20 volume % of solid lubricant and at least 10 volume % porosity.

The abrasive tools known in the art have not proven entirely satisfactory in fine precision surface grinding or polishing of ceramic components. These tools fail to meet rigorous specifications for part shape, size and surface quality in commercial grinding and polishing processes. Most commercial abrasive tools recommended for use in such operations are resin bonded superabrasive wheels designed to operate at relatively low grinding efficiencies so as to avoid surface and subsurface damage to the ceramic components. These commercial tools typically contain over 15 volume percent diamond abrasive grain having a maximum grain size of about 8 microns. Grinding efficiencies are further reduced due to the tendency of ceramic workpieces to clog the wheel face, requiring frequent wheel dressing and truing to maintain precision forms.

As market demand has grown for precision ceramic and semi-conductor components in products such as electronic devices (e.g., wafers, magnetic heads and display windows), the need has grown for improved abrasive tools for fine precision grinding and polishing of ceramics and other hard, brittle materials.

SUMMARY OF THE INVENTION

The invention is an abrasive tool comprising a backing and an abrasive rim containing a maximum of about 2 to 15 volume percent abrasive grain, the abrasive grain having a maximum grit size of 60 microns, wherein the abrasive rim comprises resin bond and at least 40 volume percent hollow filler materials, and the abrasive grain and resin bond are present in the abrasive rim in a grain to bond ratio of 1.5:1.0 to 0.3:1.0.

DESCRIPTION OF THE PREFERRED EMBODIMENTS

The abrasive tools of the invention are grinding wheels comprising a backing having a central bore for mounting the wheel on a grinding machine, the backing being designed to support a resin bonded abrasive rim along a peripheral grinding face of the wheel. The backing may be a core disc or ring formed into a planar shape or into a cup shape, or an elongated spindle or some other rigid, preformed shape of the type used to make abrasive tools. The backing is preferably constructed of a metal, such as aluminum or steel, but may be constructed of polymeric, ceramic or other materials, and may be a composite or laminate or combination of these materials. The backing may contain particles or fibers to reinforce the matrix, or hollow filler materials such as glass, silica, mullite, alumina and Zeolite® spheres to reduce the density of the backing and reduce the weight of the tool.

Preferred tools are surface grinding wheels, such as type 2A2T superabrasive wheels. These tools have a continuous or a segmented abrasive rim mounted along the narrow lip of a ring- or cup-shaped backing. Other abrasive tools useful herein include type 1A superabrasive wheels having a planar core backing with an abrasive rim around the outer circumference of the core, inner diameter (I.D.) grinding abrasive tools with an abrasive rim mounted on a shank backing, outer diameter (O.D.) cylindrical grind finishing wheels, surface grinding tools with abrasive "buttons" mounted on a face of a backing plate, and other tool configurations used to carry out fine grinding and polishing operations on hard materials.

The backing is attached to the abrasive rim in a variety of ways. Any cement known in the art for attaching abrasive components to metal cores, or to other types of backings, may be used. A suitable adhesive cement, Araldite™ 2014 Epoxy adhesive is available from Ciba Specialty Chemicals Corporation, East Lansing, Mich. Other means of attachment include mechanical attachment (e.g., abrasive rim may be mechanically screwed to the backing plate through holes placed around the rim and in the backing plate, or by dovetail construction). Slots may be grooved into the backing element and the abrasive rim, or abrasive rim segments, if the rim is not continuous, may be inserted into the slots and fastened in place by an adhesive. If the abrasive rim is used in the form of discrete buttons for surface grinding, the buttons also may be mounted onto the backing with an adhesive or by mechanical means.

The abrasive grain used in the abrasive rim is preferably a superabrasive selected from diamond, natural and synthetic, CBN, and combinations of these abrasives. Also useful herein are conventional abrasive grains, including, but not limited to alumina oxide, sintered sol gel alpha alumina, silicon carbide, mullite, silicon dioxide, alumina zirconia, cerium oxide, combinations thereof, and mixtures thereof with superabrasive grains. Finer grit abrasive grains, i.e., a maximum grain size of about 120 microns, are useful. A maximum size of about 60 microns is preferred.

Diamond abrasives are used to grind ceramic wafers. Resin bond diamond types are preferred (e.g., Amplex diamond available from Saint-Gobain Industrial Ceramics, Bloomfield, Conn.; CDAM or CDA diamond abrasive available from DeBeers Industrial Diamond Division, Berkshire, England; and IRV diamond abrasive available from Tomei Diamond Co., Ltd., Tokyo, Japan).

Metal coated (e.g., nickel, copper or titanium) diamond can be used (e.g., IRM-NP or IRM-CPS diamond abrasive available from Tomei Diamond Co., Ltd., Tokyo, Japan; and CDA55N diamond abrasive available from DeBeers Industrial Diamond Division, Berkshire, England).

Grain size and type selection will vary depending upon the nature of the workpiece, the type of grinding process and the final application for the workpiece (i. e., the relative importance of material removal rate, surface finish, surface flatness and subsurface damage specifications dictate grinding process parameters). For example, in the backgrinding and polishing of silicon or AlTiC wafers, a superabrasive grain size ranging from 0/1 to 60 micrometers (i.e., smaller than 400 grit on Norton Company diamond grit scale) is suitable, 0/1 to 20/40 microns is preferred, and 3/6 microns is most preferred. Metal bond, or "blocky", diamond abrasive types may be used (e.g., MDA diamond abrasive available from DeBeers Industrial Diamond Division, Berkshire, England). Finer grit sizes are preferred for surface finishing and polishing the back face of a ceramic or semiconductor wafer after electronic components have been attached to the front face of the wafer. In this range of diamond grain sizes, the abrasive tools remove material from silicon wafers and polish the surface of the wafer, but the abrasive tools do not remove as much material from AlTiC wafers due to the hardness of AlTiC wafers. The tools of the invention have achieved a surface finish polish as smooth as 14 angstroms on AlTiC wafers.

In the tools of the invention, the hollow filler material is preferably in the form of friable hollow spheres such as silica spheres or microspheres. Other hollow filler materials useful herein include glass spheres, bubble alumina, mullite spheres, and mixtures thereof. For applications such as backgrinding silicon wafers, silica spheres are preferred and the spheres are preferably larger in diameter than the size of the abrasive grain. In other applications, hollow filler materials may be used in diameter sizes larger than, equivalent to or smaller than the diameter size of the abrasive grain. A uniform diameter size may be obtained by screening commercially available fillers, or a mixture of sizes may be used. Preferred hollow filler materials for silicon wafer grinding may range from 4 to 130 micrometers in diameter. Suitable materials are available from Emerson & Cuming Composite Materials, Inc., Canton MA (Eccosphere™ SID-311Z-S2 silica spheres, 44$\mu$ average diameter spheres).

The abrasive grain and hollow filler material are bonded together with a resin bond. Various powdered filler materials known in the art may be added to the resin bond materials in minor amounts to aid in manufacturing the tools or to improve grinding operations. The preferred resins for use in these tools include phenolic resins, alkyd resins, polyimide resins, epoxy resins, cyanate ester resins and mixtures thereof. Suitable resins include Durez™ 33–344 phenolic powdered resin available from Occidental Chemical Corp., North Tonawanda, N.Y.; Varcum™ 29345 short flow phenolic resin powder available from Occidental Chemical Corp., North Tonawanda, N.Y.

Preferred resins for tools containing a high volume percentage of hollow filler materials (e.g., 55 to 70 volume percent spheres) are those having the ability to wet the surface of the silica and abrasive and readily spread over the surface of the silica spheres so as to adhere diamond abrasive to the surface of the spheres. This characteristic is particularly important in wheels comprising very low volume percentages of resins, such as 5–10 volume percent.

As a volume percentage of the abrasive rim, the tools comprise 2 to 15 volume % abrasive grain, preferably 4 to 11 volume %. The tools comprise 5 to 20 volume % resin bond, preferably 6 to 10 volume %, and 40 to 75 volume % hollow filler material, preferably 50 to 65 volume %, with the balance of the resin bond matrix comprising residual porosity following molding and curing (i.e., 12 to 30 volume % porosity). The ratio of diamond grain to resin bond may range from 1.5:1.0 to 0.3:1.0, and preferably is from 1.2:1.0 to 0.6:1.0.

The abrasive rim of the tools of the invention are manufactured by uniformly mixing the abrasive grain, hollow filler material and resin bond, and molding and curing the mixture. The abrasive rims may be manufactured by dry blending the components, with the optional addition of wetting agents, such as liquid resole resins, with or without a solvent, such as water or benzaldehyde, to form an abrasive mixture, hot pressing the mixture in a selected mold and heating the molded abrasive rim to cure the resin and create an abrasive rim effective for abrasive grinding. The mix is typically screened before molding. The mold is preferably constructed of stainless steel or high carbon- or high chrome-steel. For wheels having 50–75 volume % hollow filler material, care must be exercised during molding and curing to avoid crushing the hollow filler materials.

The abrasive rim preferably is heated to a maximum temperature of about 150 to 190° C. for a period of time sufficient to crosslink and cure the resin bond. Other similar curing cycles also may be employed. The cured tool is then stripped from the mold and air-cooled. The abrasive rim (or buttons or segments) are attached to a backing to assemble the final abrasive tool. Finishing or edging steps and truing operations to achieve balance may be carried out on the finished tool.

By means of resin and filler selections and curing conditions, the resin bond may be rendered relatively brittle or friable, and will break or chip faster and the abrasive tool will have less of a tendency to load with grinding debris. Commercial abrasive tools for finishing ceramic or semiconductor wafers often need to be dressed with dressing tools to clear accumulated grinding debris from the grinding face. In microabrasive grain wheels, such as the wheels of the invention, the dressing operation often wears away the wheel faster than the grinding operation. Because dressing operations are needed less frequently with the resin bonded tools of the invention, the tools are consumed more slowly and have a longer life than resin bonded tools used in the past, including wheels having higher diamond content or a stronger, less friable bond. The most preferred tools of the invention have cured bond properties that yield an optimum balance of tool life with brittleness or tendency of the bond to fracture during grinding.

Tools made with higher volume percentages of hollow filler material (e.g., 55 to 70 volume percent) are self-dressing during surface grinding and polishing operations on ceramic or semi-conductor wafers. It is believed that the incoming rough ceramic or semi-conductor wafer acts in the manner of a dressing tool to open the face of the grinding tool and release debris loaded on the face. Thus, in typical commercial operations, each new workpiece initially presents a rough surface to dress the tool and then as grinding progresses, debris begins to load the face and the tool begins to polish the workpiece surface and the power consumption begins to increase. With the tools of the invention, this cycle occurs within the power tolerances of the grinding machines and without causing workpiece burn. At the completion of the cycle with one workpiece, a new, rough surface on the next workpiece is presented to dress the face of the tool and the cycle is repeated. This capacity of the tools of the invention to grind the surface of ceramic or semi-conductor wafers without a dressing operation offers a significant benefit in the manufacture of ceramic or semi-conductor wafers.

With lower contents of hollow filler material (i. e., less than 55 volume percent), the tools of the invention require a dressing operation as the ceramic wafers are ground to a finer surface finish, because the wafer tends to load the face of the abrasive tool and power consumption increases.

The tools of the invention are preferred for grinding ceramic materials including, but not limited to, oxides, carbides, silicides such as silicon nitride, silicon oxynitride, stabilized zirconia, aluminum oxide (e.g., sapphire), boron carbide, boron nitride, titanium diboride, and aluminum nitride, and composites of these ceramics, as well as certain metal matrix composites such as cemented carbides, polycrystalline diamond and polycrystalline cubic boron nitride. Either single crystal ceramics or polycrystalline ceramics can be ground with these improved abrasive tools.

Among the ceramic and semi-conductor parts improved by using the abrasive tools of the invention are electronic components, including, but not limited to, silicon wafers, magnetic heads, and substrates.

The tools of the invention may be used for polishing or finish grinding of components made from metals or other hard materials.

Unless otherwise indicated, all parts and percentages in the following examples are by weight. The examples merely illustrate the invention and are not intended to limit the invention.

EXAMPLE 1

Abrasive wheels of the invention were prepared in the form of 11×1.125×9.002 inch (27.9×2.86×22.9 cm) resin bonded diamond wheels utilizing the materials and processes described below.

To make the abrasive rim, a blend of 4.17 wt % alkyd resin powder (Bendix 1358 resin, obtained from AlliedSignal Automotive Braking Systems Corp., Troy, N.Y.) and 11.71 wt % short flow phenolic resin powder (Varcum 29345 resin, obtained from Occidental Chemical Corp, North Tonawanda, N.Y.) was prepared. Hollow filler material in the form of 33.14 wt % silica spheres (Eccosphere SID-311Z-S2 silica, 44$\mu$ average diameter, obtained from Emerson & Cuming Composite Materials, Inc., Canton Mass.) and 50.98 wt % diamond grain (D3/6$\mu$, Amplex lot #5-683 obtained from Saint-Gobain Industrial Ceramics, Bloomfield Conn.) were mixed with the resin powder blend. Once a uniform blend was obtained, it was screened through a US#170 sieve screen in preparation for molding onto a backing to form the abrasive rim portion of the abrasive wheel.

The backing for the abrasive rim was an aluminum ring (11.067 inch outer diameter) designed for construction of a type 2A2T superabrasive grinding wheel. The base of the ring contained bolt holes for attaching the abrasive wheel to a surface grinding machine used in finishing ceramic wafers.

In preparation for molding the abrasive rim, the abrasive-bearing surface of the aluminum ring was sand-blasted and then coated with a solvent based phenolic adhesive to adhere the blend of abrasive and bond to the ring. The aluminum ring was placed into a steel mold constructed such that the aluminum ring became the bottom plate of the mold. The abrasive blend was placed in the mold and on the adhesive coated surface of the aluminum ring at room temperature, side and top molding elements were placed on the steel mold, and the assembly was placed into a preheated steam press (162–167° C.). No pressure was exerted against the abrasive rim during the initial heating stage. When the temperature reached 75° C., initial pressure was applied. The pressure was increased to 20 tons in order to reach the target density (e.g., 0.7485 g/cm$^3$), the mold temperature was increased to 160° C., and a soak time of 10 minutes carried out at 160° C. The wheel was then stripped from the mold while hot.

The inner and outer diameters of the aluminum backing and of the abrasive rim were machined to the finished wheel dimensions. A total of 36 slots (each about 0.159 cm (1/16 inch) wide) were ground into the surface of the rim to make a slotted abrasive rim.

The volume percentages of the components of these wheels and of other wheels of the invention and of a commercial, comparative wheel are shown in Table 1, below.

EXAMPLE 2

Abrasive wheels of the invention were prepared in the form of 11×1.125×9.002 inch (27.9×2.86×22.9 cm) resin bonded diamond wheels utilizing the materials and processes described below for wheel 2-A.

To make the abrasive rim, 16.59 wt % phenolic resin powder (Durez 33-344 resin, obtained from Occidental Chemical Corp, North Tonawanda, N.Y.) and 53.34 wt % silica spheres (Eccosphere SID-311Z-S2 silica spheres, 44 micron average diameter, obtained from Emerson & Cuming Composite Materials, Inc., Canton Mass.) and 30.07 wt % diamond grain (D3/6 micron, Amplex lot #5-683 obtained from Saint-Gobain Industrial Ceramics, Bloomfield Conn.) were mixed together. Once a uniform blend was obtained, it was screened through a US#170 sieve screen in preparation for molding onto a backing to form the abrasive rim portion of the abrasive wheel.

The aluminum ring backing element and the molding and curing processes of Example 1 were used to make abrasive wheel using this abrasive blend. In other versions of these wheels, higher diamond and bond contents were substituted for those of wheel 2-A to make wheel 2-B; and a high silica sphere content was substituted for that of wheel 2-A to make wheel 2-C. The volume percentages of the components of these wheels are shown in Table 1, below.

TABLE 1

Volume % Composition of Wheels

| Wheel Sample | Example 1 | Example 2-A | Example 2-B | Example 2-C | Commercial wheel[b] |
|---|---|---|---|---|---|
| Bond-resin A | 6.9 | 6.1 | 22.2[a] | 6.1 | 29.5[c] |
| Bond-resin B | 2.3 | 0 | 0 | 0 | — |
| Diamond Abrasive Grain | 11.0 | 4.0 | 14.5 | 4.0 | 19.4 |

TABLE 1-continued

| Volume % Composition of Wheels | | | | | |
|---|---|---|---|---|---|
| Wheel Sample | Example 1 | Example 2-A | Example 2-B | Example 2-C | Commercial wheel[b] |
| SiO2 spheres | 63.4 | 63.4 | 50.4 | 71.0 | 0[d] |
| Natural Porosity | 16.4 | 26.5 | 12.9 | 19.9 | 27.8 |
| Diamond: Resin Ratio | 1.2:1.0 | 0.66:1.0 | 0.65:1.0 | 0.66:1.0 | 0.66:1.0 |

[a]Phenolic resin used in this bond was a zinc catalyzed resole resin.
[b]Wheel composition was estimated from analysis of a commercial product obtained from Fujimi, Inc., Elmhurst, Illinois.
[c]Analysis indicated phenolic resin.
[d]The filler used in this wheel comprised crystalline quartz particles. The filler was not hollow. The filler particles and the abrasive grain were approximately equal in diameter (each about 3 microns).

EXAMPLE 3

Abrasive wheels made according to Example 1 (2 wheels with slotted rims) and Example 2 (2 wheels 2-A with slotted rims; and 1 wheel 2-A with unslotted rim) were finished to 27.9×2.9×22.9 cm (11×1.125×9 inch) size, and compared to a commercially available resin bonded diamond wheel (FPW-AF-4/6-279ST-RT 3.5H wheel, obtained from Fujimi, Inc., Elmhurst, Ill.) in a silicon wafer backgrinding process.

The grinding testing conditions were:

Grinding Test Conditions: Machine: Strasbaugh 7AF Model
Wheel Specifications: Type 2A2TS; 27.9×2.9×22.9 cm (11×1.125×9 inch)
Fine Grinding Process: Wheel Specification: See Table 1 Wheel Speed: 4,350 rpm Coolant: Deionized water Coolant Flow Rate: 3–5 gallons/minute Material Removed: step 1: 10$\mu$, step 2: 5$\mu$, step 3: 5$\mu$, lift: 2$\mu$ Feed rate: step 1: 1 $\mu$/s, step 2: 0.7 $\mu$/s, step 3: 0.5 $\mu$/s, lift: 0.5 $\mu$/s Dwell: 100 rev (before lift) Work Material: Silicon wafers, N type 100 orientation, (15.2 cm (6 inch) diameter surface, with flat edge); surface finish Ra about 4,000 angstroms Work Speed: 699 rpm, constant
Coarse Grinding Process: Wheel Speed: 3,400 rpm Coolant: Deionized water Coolant Flow Rate: 3–5 gallons/minute Material Removed: step 1: 10$\mu$, step 2: 5$\mu$, step 3: 5$\mu$, lift: 10$\mu$ Feed rate: step 1: 3 $\mu$/s, step 2: 2 $\mu$/s, step 3: 1 $\mu$/s, lift: 5 $\mu$/s Dwell: 50 rev (before lift) Work Material: Silicon wafers, N type 100 orientation, (15.2 cm (6 inch) diameter surface, with flat edge) Work Speed: 590 rpm, constant Where abrasive tools needed to be trued and dressed, the truing and dressing conditions established for this test were as follows:

Truing Operation:
- Disc: 38A240-HVS (obtained from Norton Company)
- Disc Size: 15.2 cm diameter (6 inches)
- Wheel Speed: 1200 rpm
- Material removed: step 1: 150$\mu$, step 2: 10$\mu$, lift: 20 $\mu$
- Feed rate: step 1: 5 $\mu$/s, step 2: 0.2 $\mu$/s, lift: 2 $\mu$/s
- Dwell: 25 rev (before lift)
- Dress of truing disc: hand held stick (38A150-HVBE stick, obtained from Norton Company)

Tests were performed in the vertical spindle plunge grinding mode on silicon wafers to measure the wheel performance after reaching a steady state grinding condition. A minimum of 200 wafers, 15.2 cm (6 inch) diameter size, having an initial surface finish of about 4,000 angstroms, had to be ground with each wheel to reach a steady state operation for measurement of fine grinding performance. Each wheel was used to remove a total of 20$\mu$ of material from the wafer in the fine grinding step described above.

Table 1 shows the performance of the wheels, as indicated by peak force of grinding, wheel wear rate (an average of measurements made after grinding 25 wafers), number of wafers ground, G-ratio and wafer burn, for the three different types of wheels, with each parameter being recorded or measured after reaching a steady state grinding condition. In silicon wafer backgrinding, when the grinding face of the wheel loads with debris being removed from the surface of the wafer, the wheel dulls, the force needed to grind increases and the wheel may begin to burn the wafer. To prevent wafer damage, the Strasbaugh grinding machine used in this test automatically halts the grinding process when the force drawn by the process exceeds a predetermined maximum (i.e., 244 Newtons (55 lbs)). For all wheels the power drawn (i.e., peak motor current in amps) was within the Strasbaugh machine limits for all wafers ground.

Wafer surface finish was measured with a Zygo™ white light interferometer (NewView 100 Id 0 SN 6046 SB 0 Model; settings: Min Mod %=5, Min Area Size=20, Phase Res.=high, Scan Length=10$\mu$ bipolar (9 sec), and FDA Res =high).

TABLE 1

| Sample | Force Newtons (lbs) | Wheel Wear rate $\mu$/wafer | Number of wafers | G-ratio | Surface Finish[a] Ra angstroms | Wafer burn |
|---|---|---|---|---|---|---|
| Example 1 Slots | 24–31 | —[b] | 75 | — | — | none |
| Example 1 Slots | 25–33 | 0.49 | 200 | 292 | 57.7 | none |
| Example 2-A slots | 17–26 | 0.47 | 200 | 306 | — | none |
| Example 2-A slots | 25–33 | 0.38 | 200 | 380 | — | None |
| Example 2-A no slots | 24–30 | 0.40 | 300 | 334 | 69.2 | None |
| Commercial Wheel | 24–30 | 0.60 | 200 | 261 | 77.1 | None |

[a]Surface finish numbers represent an average of 9 measurements/wafer and an average of 8 wafers/test. The Example 1 wheel surface finish measurements were made during a prior grinding test under identical grinding conditions with a different wheel made according to the formulation and process of Example 1.
[b]Too few wafers were ground with this wheel to make an accurate wheel wear rate measurement.

The data show that the wheels of the invention perform better than the commercial wheel. The wheels of the invention were approximately equal to the commercial wheel in peak force of grinding, but were better than the commercial wheels in wheel wear rate and in G-ratio and in obtaining a mirror finish on the wafer during fine grinding operations.

Fine grinding tests run under the same grinding conditions with the version 2-B wheel of Example 2 demonstrated acceptable wheel wear rate, g-ratio and obtaining a 50–70 angstrom surface finish on silicon wafers. Due to the lower silica sphere and higher bond and diamond grain contents of this wheel, the 2-B wheel was not self-dressing and dulled more quickly than the 2-A, 2-C and Example 1 wheels. Another test under the same fine grinding conditions demonstrated that wheel 2-C, with a higher silica sphere content (71 vs. 63.4 volume %) than wheel 2-A, showed performance comparable to wheel 2-A.

These data suggest that the high silica sphere content wheels of Examples 1, 2-A and 2-C did not dull, i.e., they were self-sharpening or self-dressing. It is believed the silica spheres in the wheels fracture to keep the wheel face open and the high percentage of silica spheres in the wheels prevent loading of the wheel face by carrying debris away from the wafer. Further, from operations made during grinding of wafers with a coarse surface (i.e., Ra about 4,000 angstroms), it is believed that the coarse surface of the incoming wafer workpiece effectively dresses the face of these Examples 1, 2-A and 2-C wheels so a separate dressing operation is not required.

Although Example 2-A wheels were identified as the wheels having the best overall grinding performance, all wheels of the invention were acceptable. The performance of the tools of the invention containing significantly less diamond grain (i.e., 4 to 14 volume %) was unexpected relative to the performance of commercial wheels containing more diamond grain (e.g., about 19 volume % diamond grain) typically used for backgrinding of ceramic or semiconductor wafers.

EXAMPLE 4

In a subsequent grinding test of the wheels of the invention (wheel 2-A), under the same operating conditions as those used in the previous Example 3, about 20$\mu$ of material was removed from a silicon wafer, and a surface finish of 50 to 70 angstroms was generated while utilizing an acceptable level of power (i.e., no wafer burn, and within Strasbaugh machine power limits).

A comparative wheel was made as described in Example 2 for wheel 2-A, except that the comparative wheel contained 10.1 volume % resin and 71.3 volume % silica spheres (i.e., no abrasive grain). This wheel containing no diamond abrasive grain in the abrasive rim removed only a negligible amount of material from the surface of the silica wafers even after reaching the machine maximum of 244 Newtons (55 lbs) of force. This comparative wheel improved the surface finish of a coarse surface silicon wafer (Ra of about 4,000 angstroms) to a surface finish of about 188 angstroms, without any sign of wafer burn. However, the abrasivefree, comparative wheel did not provide acceptable fine grinding performance (material removed, wheel wear and g-ratio) and its surface polish performance was significantly inferior to that of the commercial tool and to that of the tools of the invention.

Thus, the observed performance (removal of material and surface polishing without surface damage to the ceramic workpiece) of the abrasive tools of the invention was not observed in a tool containing only silica spheres with no abrasive grain.

We claim:

1. An abrasive grinding wheel comprising a backing having a central bore for mounting the grinding wheel on a grinding machine and an abrasive rim containing a maximum of about 2 to 15 volume percent abrasive grain, the abrasive grain having a maximum grit size of 60 microns, wherein the abrasive rim comprises 5 to 20 volume % resin bond and at least 40 volume percent hollow filler materials.

2. The abrasive grinding wheel of claim 1, wherein the hollow filler materials are selected from the group consisting of silica spheres, mullite spheres, bubble alumina, glass spheres and combinations thereof.

3. The abrasive grinding wheel of claim 2, wherein the hollow filler materials are silica spheres.

4. The abrasive grinding wheel of claim 3, wherein the silica spheres range from about 4 to 130 microns in diameter.

5. The abrasive grinding wheel of claim 1, wherein the abrasive grain is a superabrasive grain selected from the group consisting of diamond and cubic boron nitride and combinations thereof.

6. The abrasive grinding wheel of claim 5, wherein the superabrasive grain is diamond grain having a grit size range of 0/1 to 20/40 microns.

7. The abrasive grinding wheel of claim 1, wherein the porosity of the abrasive rim is from 12 to 30 volume percent.

8. The abrasive grinding wheel of claim 1, wherein the abrasive rim comprises 5 to 10 volume percent resin bond.

9. The abrasive grinding wheel of claim 1, wherein the resin bond is selected from the group consisting essentially of phenolic resins, alkyd resins, epoxy resins, polyimide resins, cyanate ester resins and combinations thereof.

10. The abrasive grinding wheel of claim 9, wherein the resin bond comprises a phenolic resin.

11. The abrasive grinding wheel of claim 1, wherein the abrasive rim comprises 50 to 75 volume percent hollow filler material.

12. The abrasive grinding wheel of claim 1, wherein the hollow filler materials are particles having an average diameter of about 44 microns.

13. The abrasive grinding wheel of claim 1, wherein the grinding wheel is selected from the group of abrasive grinding wheels consisting essentially of type 2A2 wheels, type 1A1 wheels, inner diameter wheels, outer diameter finishing wheels, slot finishing wheels and polishing wheels.

* * * * *

UNITED STATES PATENT AND TRADEMARK OFFICE

CERTIFICATE OF CORRECTION

PATENT NO. : 6,394,888 B1 
DATED : May 28, 2002
INVENTOR(S) : Dean Matsumoto, William F. Waslaske and Bethany L. Salek It is certified that error appears in the above-identified patent and that said Letters Patent is hereby corrected as shown below:

Title page,
Item [75], Inventors: delete "Sale" and insert -- Salek--
Item [73], Assignees: delete "Abrasive" and insert -- Abrasives --

Signed and Sealed this

Fifteenth Day of October, 2002

*Attest:*

*Attesting Officer*

JAMES E. ROGAN
*Director of the United States Patent and Trademark Office*